US005277095A

United States Patent [19]

Steinberger

[11] Patent Number: 5,277,095

[45] Date of Patent: Jan. 11, 1994

[54] STRING TUNER

[75] Inventor: Ned Steinberger, New Windsor, N.Y.

[73] Assignee: Steinberger Sound Corp., Newburgh, N.Y.

[21] Appl. No.: 694,470

[22] Filed: May 1, 1991

[51] Int. Cl.[5] ..... G10D 3/14

[52] U.S. Cl. ..... 84/304

[58] Field of Search ..... 84/297 R, 304, 305, 306, 312 R, 200, 208

[56] References Cited

U.S. PATENT DOCUMENTS

| | | | |
|---|---|---|---|
| 444,972 | 1/1891 | Bookser | 84/304 |
| 554,057 | 2/1896 | Durkee | 84/304 |
| 1,732,172 | 10/1929 | Smith | 84/304 |
| 2,232,453 | 2/1941 | Harvey | 84/304 |
| 4,079,652 | 3/1978 | Gittler | 84/1.16 |
| 4,366,740 | 1/1983 | Tripp | 84/298 |
| 4,608,904 | 9/1986 | Steinberger | 84/304 |
| 4,674,387 | 6/1987 | Caruth | 84/304 |
| 5,018,424 | 5/1991 | Steinberger | 84/304 |
| 5,097,736 | 3/1992 | Turner | 84/304 |
| 5,103,708 | 4/1992 | Steinberger | 84/304 |

*Primary Examiner*—Michael L. Gellner

*Assistant Examiner*—Cassandra Spyrou

*Attorney, Agent, or Firm*—Dougherty, Hessin, Beavers & Gilbert

[57] ABSTRACT

A single screw clamping tuner is provided for clamping and tuning a string of a stringed musical instrument. The tuner includes one and only one externally threaded screw which accomplishes both the clamping of a string end and the tuning of the string. The tuner includes a housing having a channel defined therein. A slider is slidably received in the channel and receives the string end therein. The one and only one screw has a first portion threadably engaged with the slider for clamping the string end against the slider. A tuning knob is threadably engaged with the one and only one screw for adjusting a position of the screw and the slider relative to the housing when the tuning knob is rotated relative to the housing to tune the string. An integral wrench carried by the tuning knob is selectively engagable with a head of the screw for rotating the screw relative to the slider to clamp or unclamp the string end against the slider.

19 Claims, 2 Drawing Sheets

STRING TUNER

BACKGROUND OF THE INVENTION

1. Field Of The Invention

The present invention relates generally to apparatus for clamping and tuning a string of a stringed musical instrument.

2. Description of the Prior Art

A stringed musical instrument typically has an instrument body with a plurality of strings mounted thereon. Each string has one end fixedly attached to the instrument body and has the other end adjustably mounted relative to the instrument body The tension in the string is varied by tightening or loosening the adjustable end so as to tune the string U.S. Pat. No. 4,366,740 to Tripp discloses a combination bridge and tail piece having a first threaded screw which clamps a string end onto a sliding member. A second threaded screw adjusts the position of the sliding member relative to the instrument body to tune the string.

U.S. Pat. No. 4,079,652 to Gittler discloses a tuning system for an electric guitar having a plurality of hollow tuning nuts which are threadedly engaged with studs which are received within the tuning nuts. Rotation of the tuning nut relative to the instrument body causes the threaded stud to slide relative to the instrument body and adjust the tension in a string which has one end attached to the sliding stud.

U.S. Pat. No. 4,608,904 to Steinberger discloses a tuning system for a stringed musical instrument having a plurality of threaded knobs which are rotated relative to the instrument body. The knobs are attached to a screw which when rotated causes translational motion of a sliding element which has the end of a string fixed thereto so as to adjust the tension in the string.

SUMMARY OF THE INVENTION

The present invention provides a single screw clamping tuner. One and only one externally threaded screw is provided to both clamp an end of and adjust the tension in each of the strings of the musical instrument.

The single screw clamping tuner has a housing with a channel defined therein. A slider is slidably received in the channel and has a string end receiving means defined in the slider. The one and only one externally threaded screw has a first portion threadably engaged with the slider for clamping a string end against the slider. A hollow cylindrical tuning knob is concentrically received about the screw and has an internal thread engaged with the screw for adjusting a position of the screw and the slider relative to the housing when the tuning knob is rotated relative to the housing so as to tune the string.

Optionally, an integral wrench means is carried by the tuning knob and is selectively engagable with the screw for rotating the screw relative to the slider to clamp or unclamp the string end against the slider.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
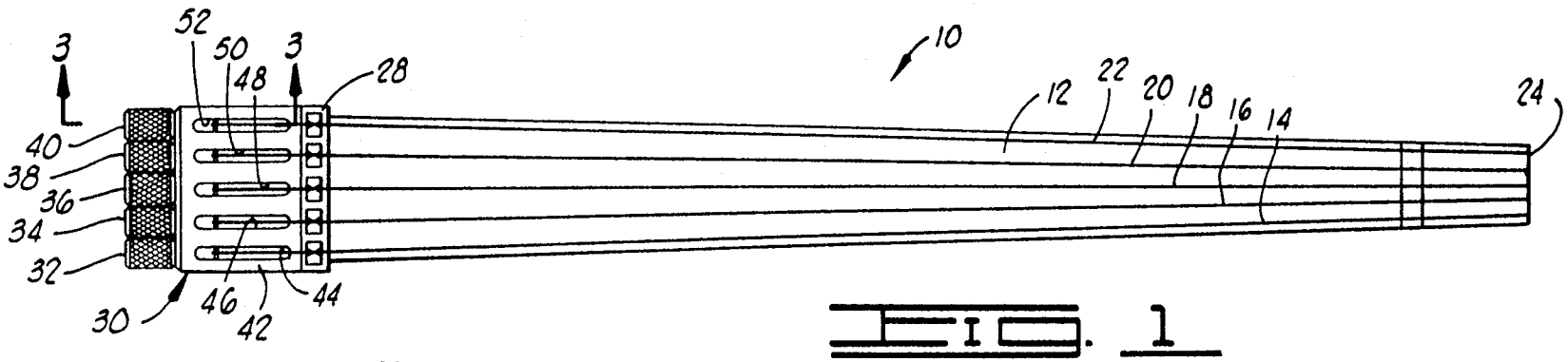
FIG. 1 is a top view of a stringed musical instrument incorporating the single screw clamping tuner of the present invention.
Figure 2:
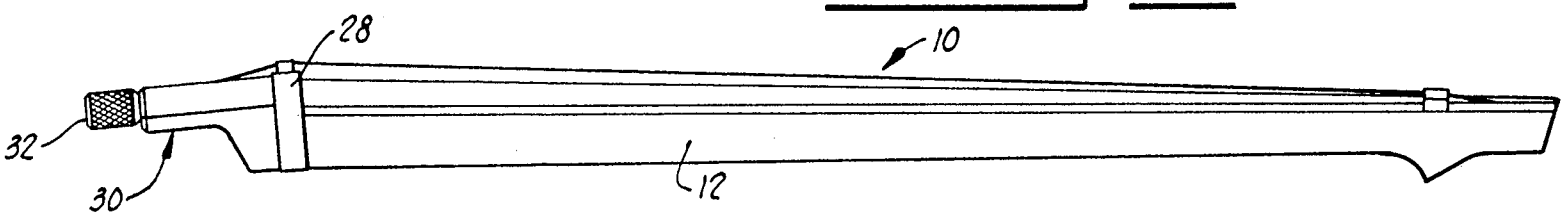
FIG. 2 is a side view of the instrument of FIG. 1.

FIGS. 1 and 2 show top and side views, respectively, of a stringed instrument generally designated by the numeral 10. The stringed instrument 10 illustrated is an electronic violin. The instrument 10 has an instrument body 12. Five strings 14, 16, 18, 20 and 22 are mounted on the instrument body 12. Each of the strings such as string 22 has a forward end 24 fixedly attached to the instrument body 12 and a rearward end portion such as 26 (see FIG. 3) which is adjustably mounted relative to the instrument body 12 as further described below. The strings extend across a bridge 28.

The rearward end of the strings such as end 26 of string 22 are adjustably mounted in a tuner assembly 30 which itself is mounted on the rearward end of the instrument body 12. The tuner assembly 30 includes first, second, third, fourth and fifth single screw clamping tuners 32, 34, 36, 38 and 40, one of which is associated with each of the strings 14–22, respectively.

Figure 3:
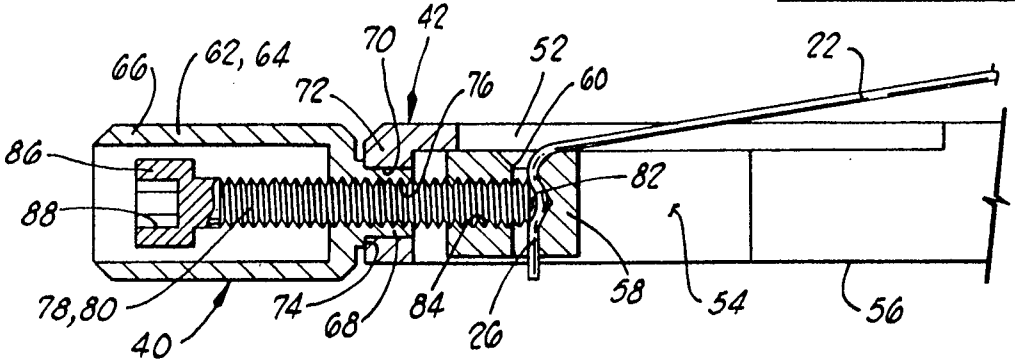
FIG. 3 is an enlarged elevation sectioned view taken along line 3—3 of FIG. 1 showing the details of one embodiment of the single screw clamping tuner.

The details of construction of the fifth single screw clamping tuner 40 are seen in FIG. 3. The other single screw clamping tuners 32-38 are similarly constructed.

The tuner assembly 30 includes a housing 42 which is common to each of the single screw clamping tuners 32–40.

The housing 42 has five slots 44, 46, 48, 50 and 52 defined through the upper surface thereof The rear end portions of the strings 14–22 extend through the slots 44–52 into engagement with the single screw clamping tuners 32–40, respectively.

The housing has five channels defined therein below the five slots 44–52. For example, as seen in FIG. 3, there is a channel 54 defined below the slot 52. The channel 54 is open to the lower surface 56 of housing 42.

The single screw clamping tuner 40 includes a slider 58 slidably received in the channel 54. Slider 58 can slide from left to right and from right to left within the channel 54 as seen in FIG. 3. The slider 58 has a vertical opening 60 defined therethrough which can be described as a string end receiving means 60. As seen in FIG. 3, the end portion 26 of string 22 extends through the opening 60 in slider 58.

The tuner 40 includes a hollow tuning knob 62 having a larger diameter rearward portion 64 with a knurled outer surface 66. The knob 62 further includes a reduced diameter stub end portion 68 which is closely rotatably received within a cylindrical bore 70 extending through a rearward wall 72 of housing 42. A shoulder 74 is defined on knob 62 adjacent the reduced diameter stub end portion 68 and bears against the end wall 72 of housing 42.

The tuning knob 62 is hollow and has a threaded bore 76 extending concentrically through the reduced diameter stub end portion 68 thereof. The outer cylindrical surface of reduced diameter stub end portion 68 is a smooth cylindrical surface which as previously mentioned is closely received within a smooth cylindrical bore 70 of housing 42 so as to be rotatable therein.

The tuner 40 includes one and only one externally threaded screw 78. The screw 78 has a threaded shaft 80 which is threadedly engaged with and extends through the threaded bore 76 of tuning knob 62. A forward end 82 of screw 78 extends through a threaded bore 84 of slider 58 and clamps the rearward portion 26 of string 22 within the opening 60 of slider 58. The threaded shaft 80 of screw 78 is threadedly engaged with the threaded bore 84 of slider 58. The threaded bore 84 of slider 58 intersects the opening 60 through slider 58.

The screw 78 has an enlarged head 86 on the rearward end thereof which has a hexagonal Allen screw socket 88 defined in the rearward end thereof.

To clamp the instrument string 22 within the tuner 40 and adjust the same, the screw 78 is first loosened so that the rearward end portion 26 of string 22 can be inserted freely through the opening 60 in slider 58.

Then the screw 78 is advanced within the threaded bore 76 by rotating the screw 78 with a tool inserted into the hollow rear end of tuning knob 62 to engage the Allen screw socket 88. The screw 78 is advanced until the rearward end portion 26 of string 22 is firmly clamped within the string receiving opening 60 of slider 58 as illustrated in FIG. 3.

Then, the string 22 can be tuned by adjusting the tension therein by rotating the tuning knob 62. This is accomplished by grasping the knurled outer surface 66 between the fingers and twisting the same to rotate the knob 62 within the housing 42. The frictional engagement of screw 78 with slider 58 prevents rotation of the screw 78, and thus the tuning knob 62 rotates relative to the screw 78 thus causing the screw 78 to be moved axially either rearward or forward relative to the housing 42 and thus relative to the instrument body 12 to adjust the tension in string 22. Thus, the screw 78 does not rotate as the string 22 is tuned. The clamping engagement of slider 58 with screw 78 prevents screw 78 from rotating. The tension in string 22 which pulls forward on the entire tuner 40 causes the shoulder 74 of tuning knob 62 to bear against the rear wall 72 of housing 42.

Figure 6:
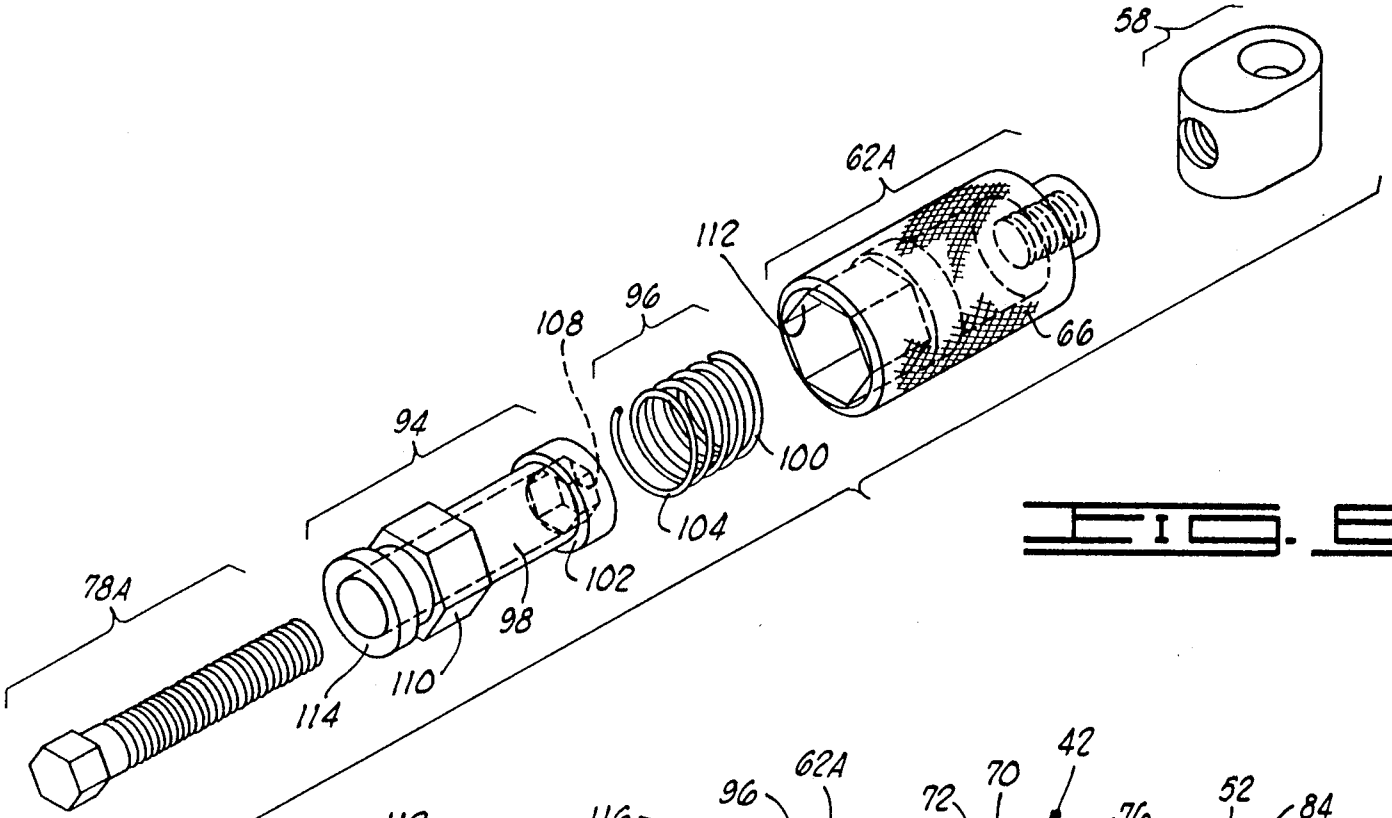
FIG. 6 is an exploded isometric view of the components of the tuner of FIG. 4, other than the housing.
Figure 4:
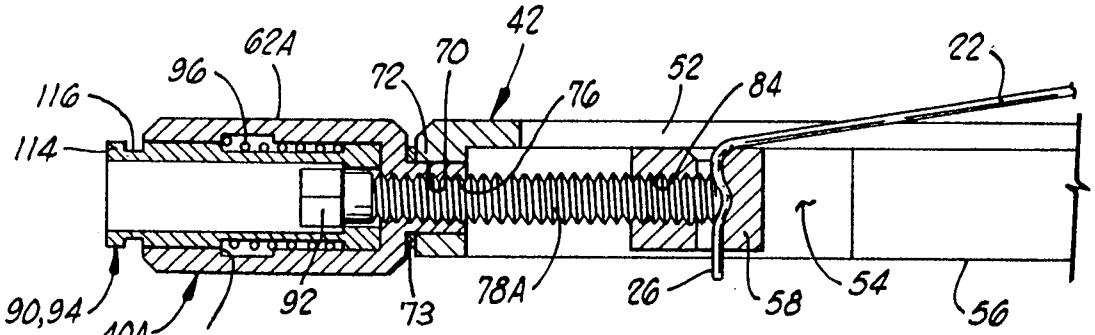
FIG. 4 is a view similar to FIG. 3 of an alternative embodiment of the single screw clamping tuner which incorporates an integral wrench means.
Figure 5:
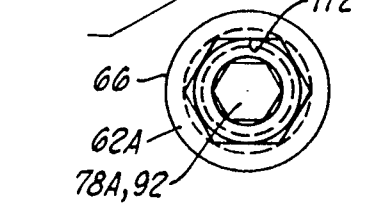
FIG. 5 is a left end view of the tuner of FIG. 4.

The Alternative Embodiment Of FIGS. 4–6

Turning now to FIGS. 4–6, an alternative embodiment of the tuner 40 is illustrated. The tuner of FIG. 4 is generally designated by the numeral 40A. Elements of the tuner 40A which are essentially identical to those of the tuner 40 are identified by the identical numerals used with regard to FIG. 3, and that description need not be repeated herein.

In the tuner 40A of FIG. 4, both the tuning knob and the screw which are now designated as 62A and 78A, respectively, have been modified to accommodate an integral wrench means 90 which is now carried by the tuning knob means 62A and is selectively engagable with the screw 78A for rotating the screw 78A relative to the slider 58 to clamp or unclamp the string end 26 against the slider 58.

The screw 78A now has a hexagonal shaped enlarged end 92 defined on the rear end thereof. The integral wrench means 90 includes a knob core 94 which is slidably received within the knob 62A. A coil compression spring 96 is concentrically located about a reduced diameter exterior portion 98 of knob core 94 and has a forward end 100 which abuts a shoulder 102 on knob core 94 and has a rearward end 104 which abuts an internal shoulder 106 of tuning knob 62A.

The knob core 94 has a hexagonal socket 108 defined in the forward end thereof as best seen in the exploded isometric view of FIG. 6 in dashed lines. The socket 104 is complementary to and is designed to selectively receive the hexagonal head 92 of screw 78A.

The spring 96 biases the knob core 94 toward a disengaged position as seen in FIG. 4 wherein the socket 108 is located forward of the hex head 92 of screw 78A so that rotation of the tuning knob 68A and the knob core 94 does not cause the screw 78A to rotate relative to housing 42. The knob core 94 has a hexagonal shaped enlarged portion 110 which is slidably and closely received within a complementary hexagonal shaped socket 112 of tuning knob 62A so that when the tuning knob 62A is rotated, the knob core 94 rotates therewith. The knob core 94 can slide relative to tuning knob 62A, however, to the extent permitted by the spring 96.

A rearward portion 114 of knob core 94 extends out the open rear end of tuning knob 62A when the knob core 94 is in its disengaged position as seen in FIG. 4. An annular groove 116 near the rear end portion 114 of knob core 94 can be grasped with the fingernails of a human hand so that the knob core 114 can be pulled rearwardly relative to tuning knob 62A thus compressing spring 96 and moving the hex socket 108 of the forward end of knob core 94 into engagement with the hex head 92 of screw 78A. Then rotation of the tuning knob 62A and knob core 94 relative to housing 42 will also rotate screw 78 relative to housing 42. The slider 58 is non-rotatably held within the channel 54 so that the threaded engagement of screw 78A with the threaded bore 84 of slider 58 can be adjusted so that the string 22 can be released from slider 58 or can be clamped to slider 58 as desired.

Upon releasing the knob core 94, the spring 96 will move it back to its disengaged position as seen in FIG. 4.

To tune string 22, the tuning knob 62A is rotated within housing 42. The screw 78 does not rotate, but rather is axially advanced or retracted due to the rotation of the internal thread 76 of tuning knob 62A, thus adjusting the tension in string 22.

The knob 62A can be generally described as a hollow cylindrical knob having the knob core 94 concentrically received therein, which in turn has the screw 78A concentrically received therein. The spring 96 is itself concentrically received about the knob core 94 and within the tuning knob 62A.

Also in the embodiment of FIG. 4 a washer 73 has been placed between knob 62A and rear wall 72 of housing 42. The knob 62A can be considered to include the washer 73 so that knob 62A can still be described as bearing against the wall 72 of housing 42.

Each of the tuners 32–40 seen in FIG. may be constructed like the tuner 40A of FIGS. 4–6. The tuner 40A can be generally described as having one and only one externally threaded screw 78 which performs the functions both of clamping the string end 26 of string 22 and tuning the string 22. This is contrasted to prior art devices such as for example that seen in U.S. Pat. No. 4,366,740 to Tripp which utilizes two externally threaded screws, one to accomplish the clamping function and a second to accomplish the tuning function.

In the present invention, the clamping function is accomplished by rotating the one and only one threaded screw 78A relative to the body 12 of the instrument 10. The tuning function is accomplished by axially moving the one and only one threaded screw 78 relative to the instrument body 12 without rotating the threaded screw 78 relative to the instrument body 12.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art which changes are encompassed within the scope and spirit of the present invention as defined by the appended claims.

What is claimed is:

1. An apparatus for clamping and tuning a string of a stringed musical instrument, comprising:

a housing having a channel defined therein;

a slider slidably received in said channel, said slider having defined therein a string end receiving means;

one and only one externally threaded screw having a first portion threadably engaged with said slider and arranged to clamp said string against said slider; and a tuning knob means having an internal thread directly threadedly engaged with said one and only one externally threaded screw for adjusting a position of said screw and said slider relative to said housing when said tuning knob means is rotated relative to said housing to tune said string.

2. The apparatus of claim 1, wherein:

said tuning knob means is a hollow cylindrical tuning knob means; and said screw is concentrically received in said hollow cylindrical tuning knob means.

3. An apparatus for clamping and tuning a string of a stringed musical instrument, comprising:

a housing having a channel defined therein;

a slider slidably received in said channel, said slider having defined therein a string end receiving means;

a screw having a first portion threadably engaged with said slider and arranged to clamp said string against said slider;

a tuning knob means threadedly engaged with said screw for adjusting a position of said screw and said slider relative to said housing when said tuning knob means is rotated relative to said housing to tune said string; and integral wrench means, carried by said tuning knob means and selectively engagable with said screw, for rotating said screw relative to said slider to clamp or unclamp said string against said slider.

4. The apparatus of claim 3, further comprising:

spring means for biasing said integral wrench means toward an unengaged position wherein rotation of said wrench means does not rotate said screw.

5. The apparatus of claim 4, wherein:

said integral wrench means is a hollow cylindrical wrench means concentrically disposed about said screw and within said tuning knob means.

6. The apparatus of claim 5, wherein:

said spring means is concentrically disposed between said wrench means and said tuning knob means and has one axial end abutting said wrench means and another axial end abutting said tuning knob means.

7. The apparatus of claim 3, wherein:

said integral wrench means is a hollow cylindrical wrench means concentrically disposed about said screw and within said tuning knob means.

8. The apparatus of claim 7, wherein:

said wrench means has a socket defined therein which engages a polygonal shaped head of said screw when said wrench means is engaged with said screw.

9. The apparatus of claim 3, wherein:

said wrench means is axially slidable relative to said tuning knob means and is rotationally fixed relative to said tuning knob means.

10. The apparatus of claim 1, wherein:

said tuning knob means is axially fixed relative to said housing when said knob is rotated to tune said string.

11. An apparatus for tuning a string of a stringed musical instrument, comprising:

a housing having a cylindrical opening defined therein, said housing also having a channel defined therein;

a hollow tuning knob having a reduced diameter stub end portion closely rotatably received in said cylindrical opening of said housing, said stub end portion having an internal thread extending axially concentrically therethrough;

a screw threadedly engaged with and extending through said internal thread of said stub end portion of said hollow tuning knob; and string end attachment means for fixing an end of said string relative to said screw so that when said tuning knob is rotated relative to said housing said screw moves axially relative to said knob and said housing to tune said string, said string end attachment means including a slider separable from said screw and slidably and non-rotatably received in said channel of said housing.

12. The apparatus of claim 11, wherein:

said slider is operably associated with said screw and is arranged to clamp said string end between said screw and said slider to fix said string end relative to said screw and said slider.

13. The apparatus of claim 11, wherein:

said string end attachment means is a means for clamping said string end therein with said screw.

14. The apparatus of claim 11, wherein:

said tuning knob has a shoulder adjacent said reduced diameter stub end portion, and said shoulder bears against said housing when said string is placed in tension.

15. A stringed musical instrument, comprising:

an instrument body;

a plurality of strings mounted on said body; and a plurality of single screw clamping tuner means, one of said plurality being associated with each of said strings for both clamping an end portion of one of the strings and tuning said one of the strings, each one of said single screw clamping tuner means including one and only one externally threaded screw.

16. The instrument of claim 15, wherein:

each of said single screw clamping tuner means includes a tuning knob rotatably mounted relative to said instrument body, said tuning knob being hollow and having said one and only one externally threaded screw concentrically disposed therein

17. The instrument of claim 16, wherein:

each of said single screw clamping tuner means includes an integral wrench means carried by said tuning knob and selectively engagable with said one and only one externally threaded screw, for rotating said screw relative to said body to clamp said end portion of said string relative to said screw.

18. A method comprising:

clamping a string of a stringed musical instrument with one and only one externally threaded screw; and tuning said string of said musical instrument with said one and only one externally threaded screw.

19. The method of claim 18, wherein:

said clamping is accomplished by rotating said one and only one externally threaded screw relative to a body of said musical instrument; and said tuning is accomplished by axially moving said one and only one threaded screw relative to said body of said musical instrument without rotating said one and only one externally threaded screw relative to said body of said musical instrument.

* * * * *